US009257024B2

(12) United States Patent
Belden, Jr. et al.

(10) Patent No.: US 9,257,024 B2
(45) Date of Patent: Feb. 9, 2016

(54) THEFT DETERRENT DEVICE

(75) Inventors: Dennis D. Belden, Jr., Canton, OH (US); Michael Rapp, Modautal (DE)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 653 days.

(21) Appl. No.: 13/363,435

(22) Filed: Feb. 1, 2012

(65) Prior Publication Data

US 2013/0194096 A1 Aug. 1, 2013

(51) Int. Cl.
*G08B 13/14* (2006.01)
*G08B 13/12* (2006.01)

(52) U.S. Cl.
CPC ..... *G08B 13/1463* (2013.01)

(58) Field of Classification Search
CPC ..... G08B 13/14
USPC ..... 340/568.4
See application file for complete search history.

(56) References Cited

U.S. PATENT DOCUMENTS

| | | | | |
|---|---|---|---|---|
| 5,050,836 | A | 9/1991 | Makous | |
| 5,146,205 | A | 9/1992 | Keifer et al. | |
| 5,689,237 | A * | 11/1997 | Sasagawa et al. | 340/572.8 |
| 5,808,371 | A | 9/1998 | Kon'i et al. | |
| 6,147,603 | A | 11/2000 | Rand | |
| 6,257,930 | B1 | 7/2001 | Yu | |
| 6,300,874 | B1 | 10/2001 | Rand | |
| 6,459,374 | B1 * | 10/2002 | Rand et al. | 340/568.2 |
| 6,902,432 | B2 | 6/2005 | Morikawa et al. | |
| 7,015,596 | B2 * | 3/2006 | Pail | 307/28 |
| 7,121,852 | B2 | 10/2006 | Ng et al. | |
| 7,470,148 | B1 | 12/2008 | Su et al. | |
| 7,553,172 | B2 | 6/2009 | Chiu et al. | |
| 7,626,500 | B2 * | 12/2009 | Belden et al. | 340/568.1 |
| 7,815,469 | B1 | 10/2010 | Nguyen et al. | |
| 8,395,907 | B2 * | 3/2013 | Marszalek et al. | 361/807 |
| 2012/0091824 | A1 * | 4/2012 | Campolo et al. | 307/135 |

* cited by examiner

*Primary Examiner* — Jennifer Mehood
*Assistant Examiner* — John Mortell
(74) *Attorney, Agent, or Firm* — Nelson Mullins Riley & Scarborough LLP

(57) ABSTRACT

A system and method for protecting a merchandise item is presented. An alarm system for protecting the merchandise item includes: an alarm logic, a cable, and a switch. The cable has first and second ends with the first end adapted to be plugged into the alarm system. The switch is located at the second end of the cable and indicates when the second end of the cable is attached to the merchandise item and when the second end of the cable is not connected to the merchandise item. The second end of the cable can be connected to a standard port located on the merchandise item. The alarm system generates an alarm when the second end of the cable is not connected to the merchandise item.

20 Claims, 8 Drawing Sheets

THEFT DETERRENT DEVICE

BACKGROUND OF THE INVENTION

1. Field of Invention

The current invention relates generally to apparatus, systems and methods for protecting merchandise items from theft. More particularly, the apparatus, systems and methods relate to attaching a cable to merchandise items that are on a display stand to allow the items to be handled and generate an alarm if the cable is removed. Specifically, the apparatus, systems and methods provide for attaching a cable with a standard connector with a switch within the standard connector that activates and alarms if the switch detects that the cable is removed from a merchandise item.

2. Description of Related Art

Merchants use a variety of methods to protect their merchandise from theft. A common approach to solving this problem is to attach electronic article surveillance (EAS) tags to merchandise in a variety of ways. Foil and/or paper EAS tags can be attached to merchandise items with adhesive so that they are not easy to remove. When these merchandise items are brought near a surveillance gate near an entrance to a store selling these items, they cause the security gate to sound alarms indicating a possible theft. However, for more expensive items such as laptop computers, cellular phones and other electronic equipment, thieves will take the time to find and carefully remove EAS tags before stealing the merchandise.

Another way merchants try to protect merchandise is to tether the merchandise to a display stand. For example, a mechanical tether that is difficult to cut can be locked onto a laptop computer or other electronic device. The laptop computer is then displayed so that it can be handled and viewed by a potential buyer. However, this tether must be mechanically strong to ensure that it cannot be removed or cut from the merchandise item with special tools, thus deterring thieves. However, using a heavy duty tether that is difficult to remove adds cost to the display. What is needed is a better way to display merchandise.

SUMMARY OF THE INVENTION

The preferred embodiment of the present invention includes an alarm system for protecting a merchandise item. The alarm system is comprised of an alarm logic, a cable and a switch. The cable has first and second ends with the first end adapted to be plugged into the alarm system. The switch is located at the second end of the cable and indicates when the second end of the cable is attached to the merchandise item and when the second end of the cable is not connected to the merchandise item. The second end of the cable can be connected to a standard port located on the merchandise item. The second end of the cable may be connectable to standard port compatible with the Universal Serial Bus (USB) standard, the USB type B standard, the Registered Jack-45 (RJ-45) standard or another standard connector. The alarm system generates an alarm when the second end of the cable is disconnected from the merchandise item. In some embodiments, the switch is mounted on a printed circuit board (PCB). A light emitting diode can be mounted on the PCB configured to indicate when the connector housing is attached to the merchandise item. The switch can be a plunger type of switch.

In another configuration of the preferred embodiment, a connector housing is located at the second end of the cable with the switch at least partially within the connector housing. The connector housing can be connected to the standard port on the merchandise item. The PCB can be located at least partially in the connector housing.

In some configurations, an elongated foil strip with a first end can be attached to the housing and a second end can be attached to the merchandise item. The alarm logic generates an alarm when the elongated foil strip is severed or removed from the connector housing. An electrical conductor within the foil strip can form a loop between two ends of the conductor. The alarm logic generates an alarm when the loop is severed. A locking door with an open position and a closed position can be located on the housing. When the locking door is in the closed position it secures the foil strip to the connector housing.

Another configuration of the preferred embodiment is a method of protecting a merchandise item. The method connects a flexible strip between the alarm connector and the merchandise item. An alarm is generated when the flexible strip is severed or removed from the alarm connector.

In another configuration of the method, a flexible strip is connected between the alarm connector and the merchandise item. An alarm is generated when the flexible strip is severed or removed from the alarm connector.

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
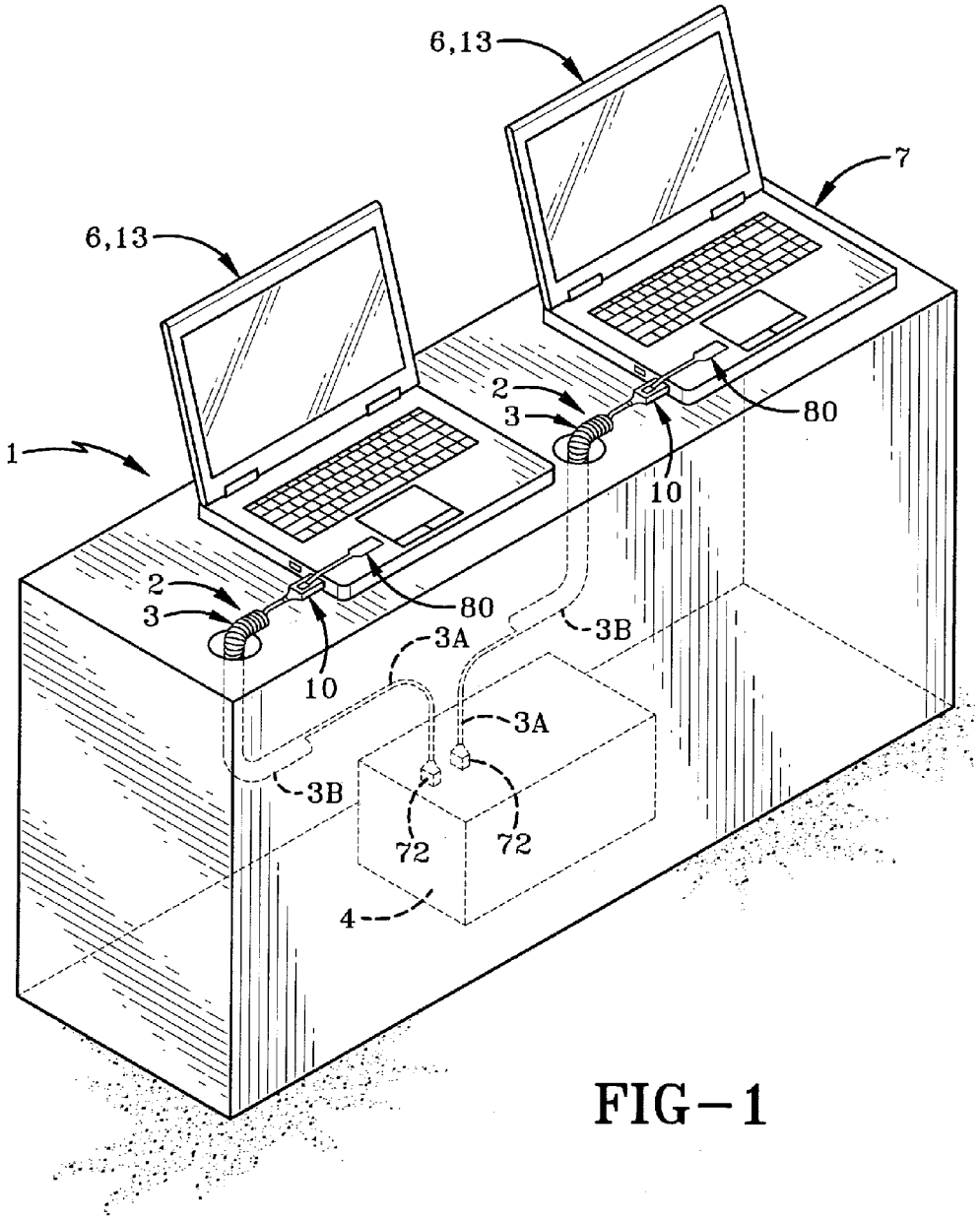
FIG. 1 illustrates a preferred embodiment of an alarm system with an alarm connector that fits into another standard connector.

FIG. 1 illustrates the preferred embodiment of an alarm system 1. Alarm system 1 includes a cable 3, an alarm connector 10 and a plug 72. The cable 3 includes a coiled portion 3B and one or more straight portions 3A. Alarm connector 10 is connected to a first end 9 of a cable 3 and a standard plug 72 is connected to the other end 8 of the cable 3. The alarm connector 10 is connected to a standard port such as a USB-type port on a merchandise item 13 resting on merchandise display 7 and the opposite end of cable 3 is connected to an alarm logic 4. In FIG. 1, alarm connector 10 is shown connected to a laptop computer 6 but it can be connected to any type of merchandise item 13 such as a camera, cellular telephone, electronic device or the like. The arrangement of the alarm system 1 allows a potential buyer of the laptop 6 to pick up and handle the laptop 6 while it is securely monitored at merchandise display 7

As discussed further below, the alarm connector 10 can be any standard connector such as a Universal Serial Bus (USB) 2.0, USB 3.0, USB, USB type A, USB type B, USB type Mini-B, USB micro-AB, USB micro-B, Registered Jack-26X (RJ-26X), RJ-38X, RJ-45, RJ-45S, RJ-48X, or any other standard connector as understood by those of ordinary skill in the art. Also, as discussed further below and best seen in FIG. 4, alarm connector 10 has a built-in switch 42 that detects when the alarm connector 10 is removed from the laptop 6. This allows alarm system 1 to detect when alarm connector 10 is unplugged from the laptop 6. Alarm system 1 can also be configured to generate an alarm when the cable 3 is severed. The alarm system 1 of FIG. 1 is easy to set-up and lower in cost than similar traditional alarm systems because there is no need for an expensive mechanical type of tethering device because the single alarm connector 10 and cable 3 allow for the detection of unauthorized removal of the alarm connector 10 from the laptop 6 or the severing of the cable 3.

"Logic", as used herein, includes but is not limited to hardware, firmware, software and/or combinations of each to perform a function(s) or an action(s), and/or to cause a function or action from another logic, method, and/or system. For example, based on a desired application or need, logic may include a software controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

Figure 2:
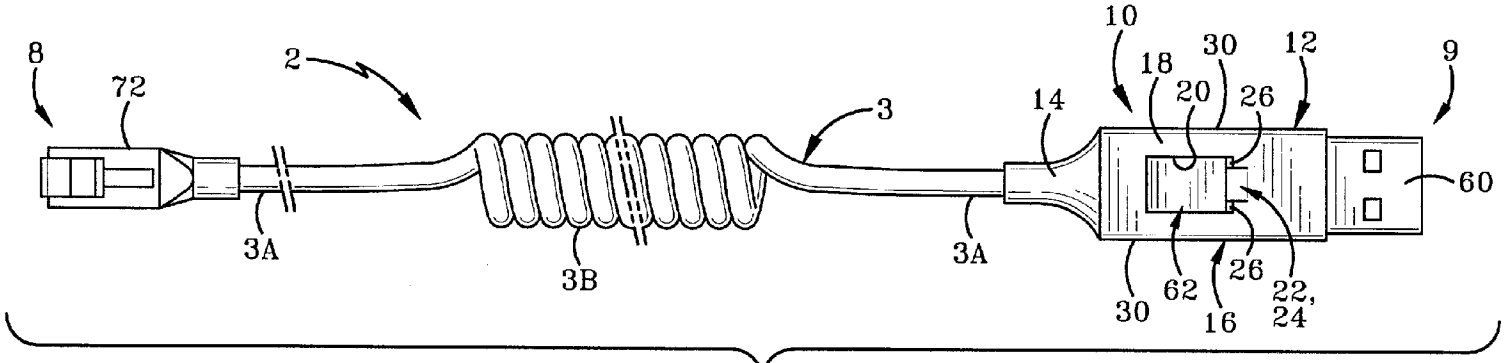
FIG. 2 illustrates a top view of a second embodiment of a cable with an alarm connector that fits into another standard connector.
Figure 3:
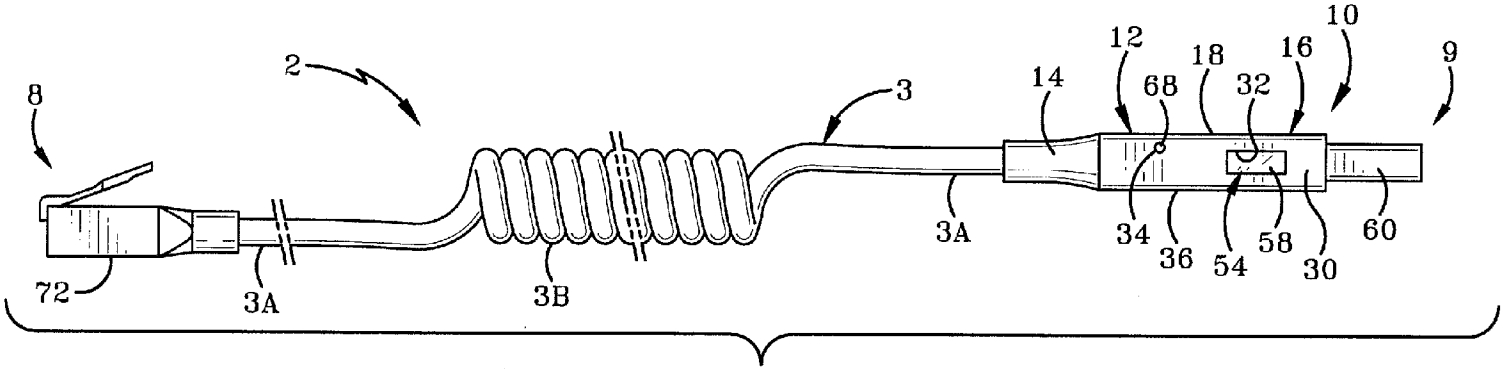
FIG. 3 illustrates a side view of the second embodiment of a cable with an alarm connector that fits into another standard connector.

As illustrated in FIGS. 1-3, the cable 3 may have a coiled cable portion 3B that automatically recoils when force is removed from the two ends of the cable. The cable 3 can be a four conductor cable for connecting to a four conductor alarm connector 10 that is compatible with a USB-type of socket. Of course, the cable can have any number of conductors and can be compatible with other types of standard connectors. As best seen in FIGS. 2 and 3, the alarm connector end of cable 3 is connected to a strain relief 14. Strain relief 14 acts to spread out bending forces at this end of the cable 3. One end of the cable 3 is connected to the plug 72 that can be plugged into the alarm logic 4. In the preferred embodiment, plug 72 is a standard connector such as an RJ-22 connector or the like.

Figure 4:
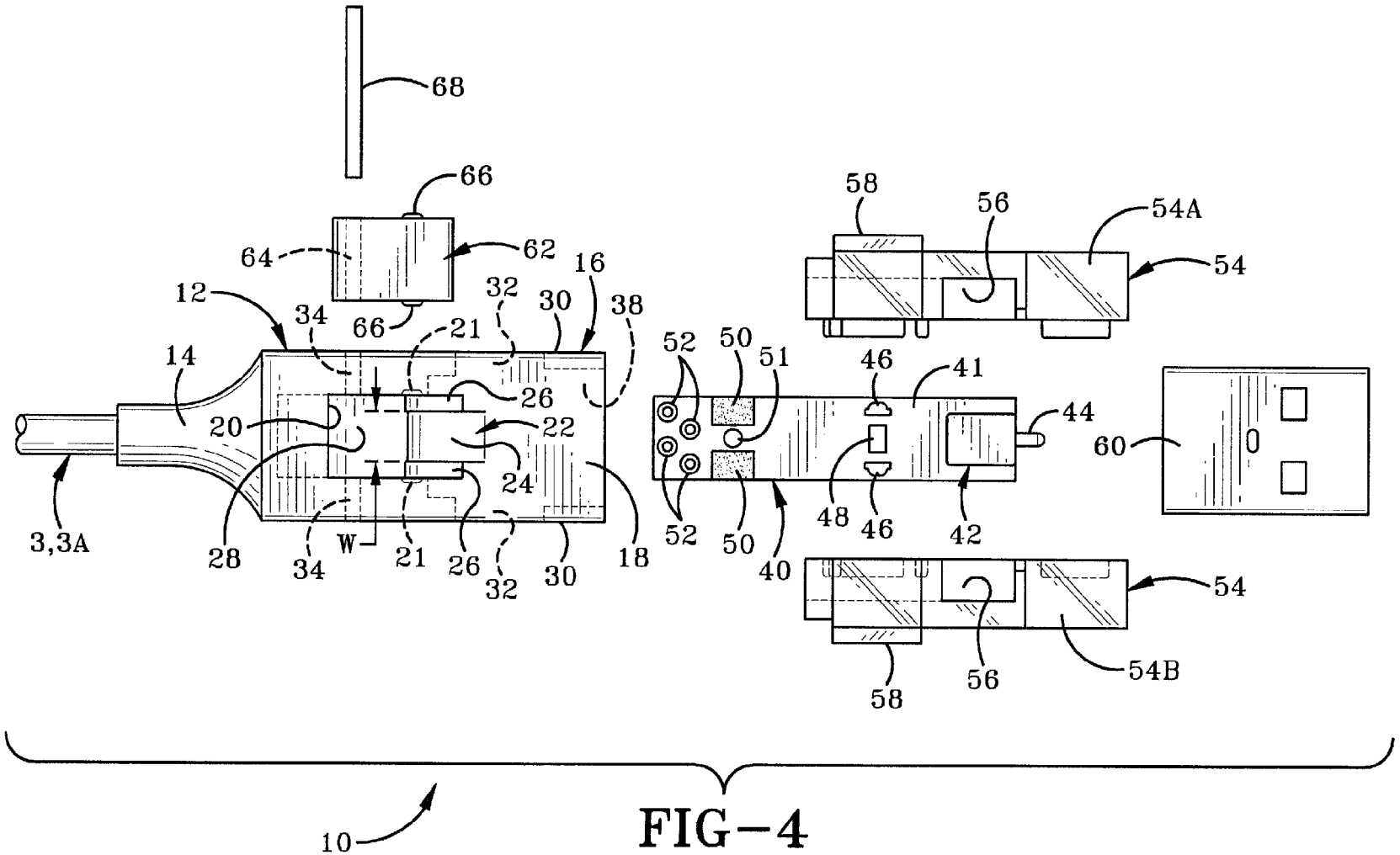
FIG. 4 illustrates an exploded view of the second embodiment of a cable with an alarm connector that fits into another standard connector.

As best seen in FIG. 4, switch 42 can be mounted on a circuit board 41 that is part of a printed circuit board (PCB) 40. In the preferred embodiment, the alarm connector end 9 of cable 3 is terminated with its connectors connected to wire connection pads 52 on the PCB 40. In the preferred embodiment, one or more diodes 48 are mounted on circuit board 41 and are configured to detect when the alarm connector 10 is removed from merchandise item 13. Switch 42 can be a plunger-type of switch with a plunger 44 or another type of switch. In another configuration of the preferred embodiment, one or more light emitting diodes (LEDs) 46 are mounted on the circuit board 41 and are configured to indicate when the alarm connector 10 is removed from merchandise item 13. The PCB 40 further includes contact pads 50 to connect to a flexible attachment device 82 that is discussed later, as well as a hole 52 that is also discussed in greater detail below.

In the preferred embodiment, alarm connector 10 includes a main housing 12 that includes a top wall 18. The main housing 12 also includes a housing portion 54 and an interior portion 38 of main housing 12 to form a circuitry housing portion 16 of the overall main housing portion 12. Housing portion 54 further includes a left housing portion 54A and a right housing portion 54B. Housing portions 54A and 54B are configured to house circuit board 41 with its switch 42 and form the shape of alarm connector 10 so that it is shaped as a standard connector that can fit into a standard socket. Housing 54 includes chamber 56 for receiving the switch 42, as well as clear windows 58 to allow the LEDs 46 to transmit light through. Also, alarm connector 10 can include a connector shield 60 such as a USB connector shield or another type of shield and the housing 12 is configured to mount this shield 60 with the circuit board 40 at least partly projecting into an opening of the shield 60.

Figures 5, 6:
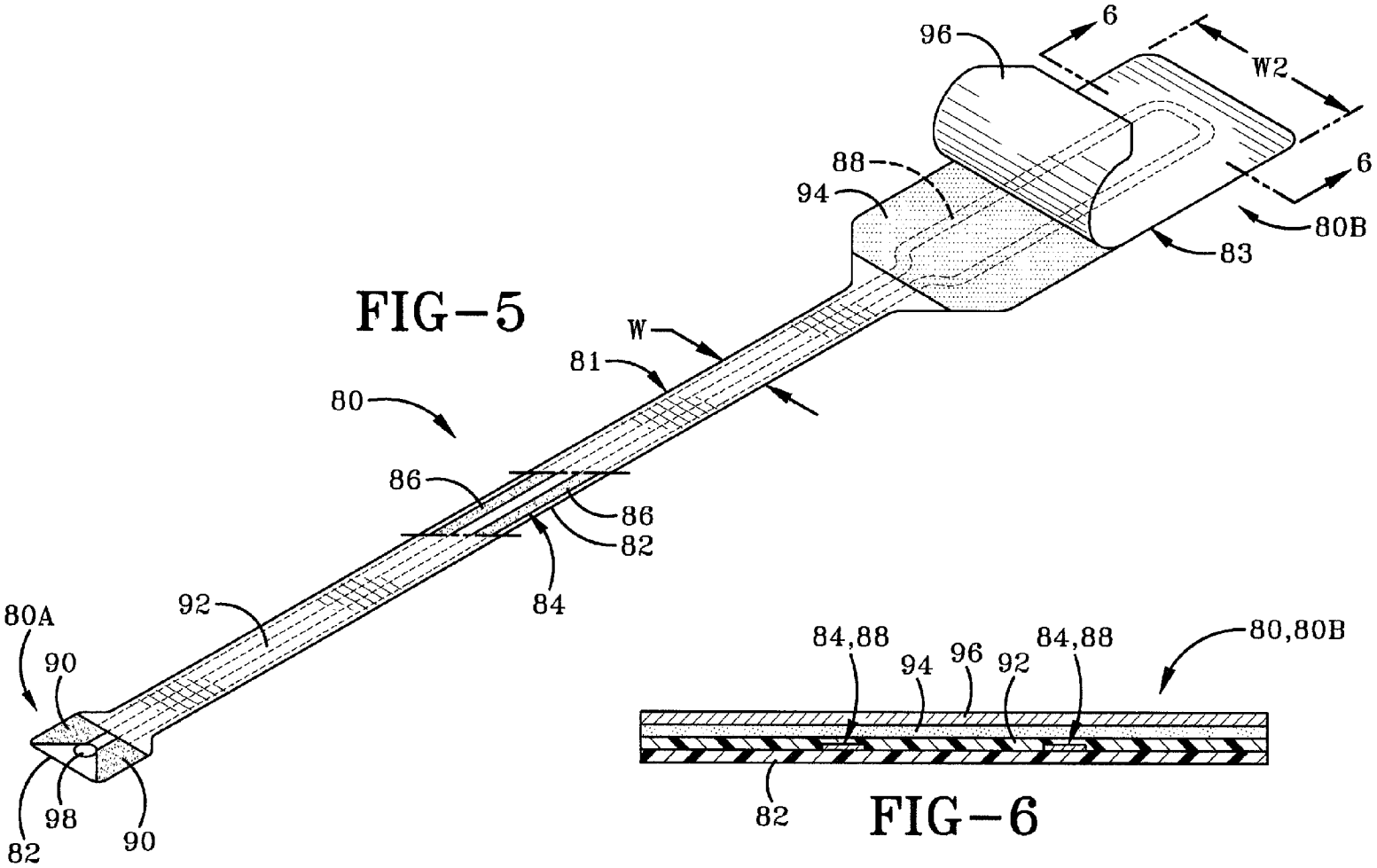
FIG. 5 illustrates a flexible attachment device.
FIG. 6 illustrates a cross-sectional view of the flexible attachment device.

In a second embodiment, the alarm connector 10 can include a flexible attachment device 80 as shown in FIG. 5. The flexible attachment device 80 can be formed out of a type of polymer or plastic material, flexible metal or any other suitable material that is flexible. The flexible attachment device 80 includes adhesive material 94 at one end that has a wider contact portion 83 so that this end can be attached to the merchandise item 13. The adhesive material 94 can be covered with a protective layer 96 so that the adhesive material 94 is prevented from sticking to something before the flexible attachment device 80 is to be attached to a merchandise item 13. The other end of flexible attachment device 80 is adapted to be placed into chamber 28 of the alarm connector 10. An electrical conductor 84 is sandwiched between a main layer 82 and a protective layer 92. Two ends terminate at contact pads 90 and the end 80A of a narrow portion 81 of the flexible attachment device 80. The electrical conductor 84 forms a loop 87 at a wider portion 83 at one end 80B of the flexible attachment device 80. In the preferred embodiment, the wider portion 83 has a width size W2 of about 3-4 times width W of the narrow portion 81.

Figure 7:
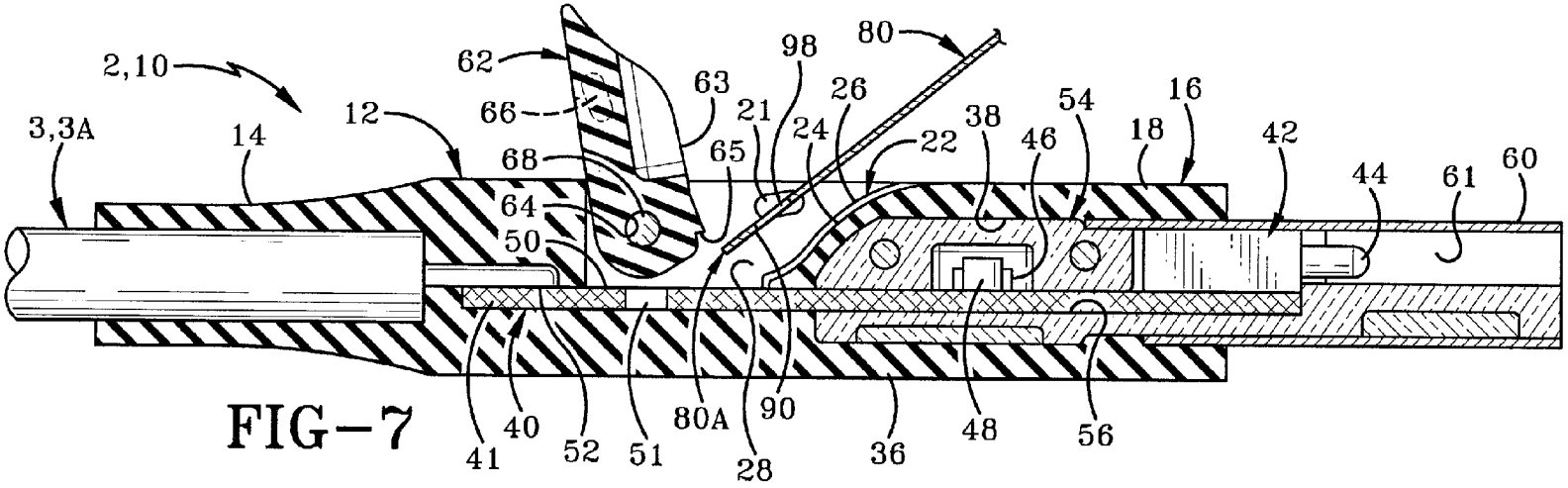
FIG. 7 illustrates a cross-sectional view of the second embodiment of the alarm connector with its door in an open position.
Figure 8:
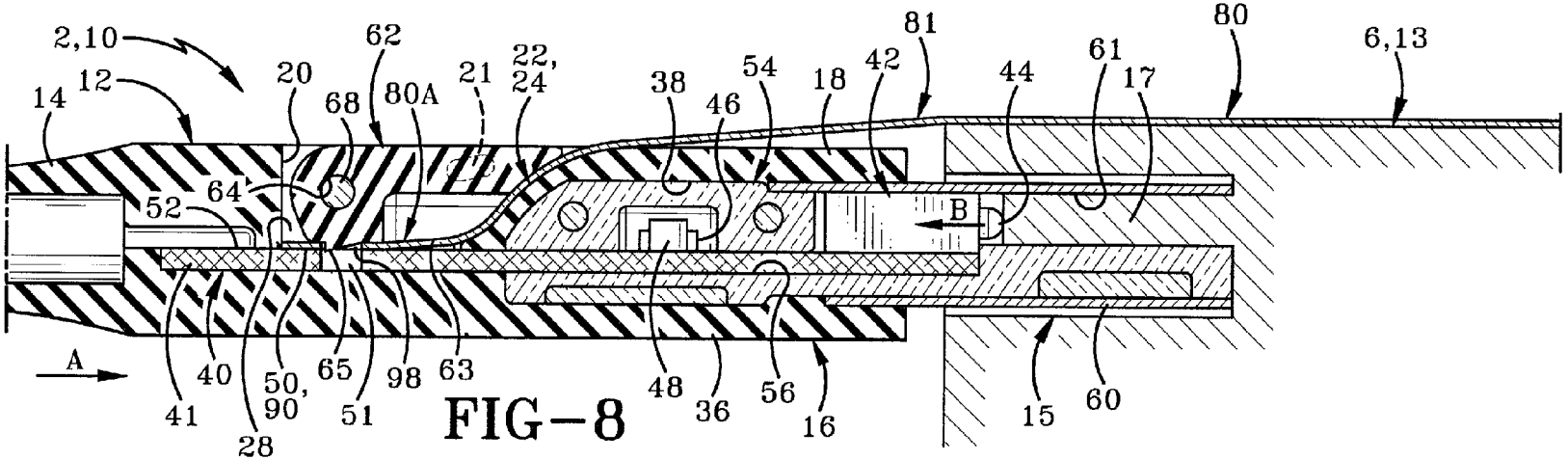
FIG. 8 illustrates a cross-sectional view of the second embodiment of the alarm connector with its door in a closed position.

As best seen in FIGS. 7 and 8, in the second embodiment, the main housing 12 further includes a chamber 28, a nub recesses 21 and a ramp 22 that includes a recessed portion 24 and a non-recesses portion 26. A chamber 28 is formed and defined by the ramp 22 and the opening 20. A locking door 62 with a bottom wall 64 is mounted to the housing 12 and is adapted to move to a closed position to lock the flexible attachment device 80 to the housing 12 with the electrical conductor 26 in electrical contact with the circuit board 41. For example, door 62 can be mounted on a pin 68 mounted in an aperture 64 so that it can swivel about the pin 68 and move between open and closed positions. The alarm connector can have locking nubs 66 within the chamber 28 so that when the door is closed the door nubs 66 fit within the nub recesses 21 to somewhat lock the door closed. The locking door 62 and housing 12 are adapted to lock the flexible attachment device 80 to the housing 12 so that relatively little force is needed to pull the flexible attachment device 80 from the housing 12.

Having described the components of security system 1 and the alarm connector 10, their operation will now be described with reference to a method of protecting merchandise items. As shown in FIG. 8, as alarm connector 10 is attached to port 15 on merchandise item 13, plunger 44 of switch 42 will be depressed in the direction of Arrow B by a projection 17 of port 15 on the merchandise item. Circuits on PCB 40 and/or alarm logic 4 will detect this and place the alarm logic 4 in an alarm state. Now, if plunger 44 is released by pulling the alarm cable 10 out of the merchandise item 13 or the cable 3 is severed, alarm logic 4 will detect this and generate an appropriate alarm.

The second embodiment includes removing protective layer 96 from the flexible attachment device 80 and attaching adhesive layer 94 to the merchandise item 13. As best seen in FIGS. 7 and 8, narrow end 80A with its contact pads 90 are then slid into chamber 28 of the main housing 12 and down ramp 22 as door 62 is rotated so that hook portion 65 of door 62 can engage hole 98 of flexible attachment device 80. Hook portion 65 continues to engage hole 98 so that flexible attachment device 80 is pulled into chamber 28 until the hook passes into hole 51 in the printed circuit board 40 and locking nubs 66 of door 62 are pressed into the nub recesses 21 of main housing 12. In this locked position, contact pads 90 of the flexible attachment device 80 are in electrical contact with the contact pads 50 of the PCB 40. In this configuration, if the flexible attachment device 80 is severed or if flexible attachment device 80 is pulled from PCB 40, the alarm logic 4 will detect that the electrical conductor 84 is open and will generate an appropriate alarm.

Figure 9:
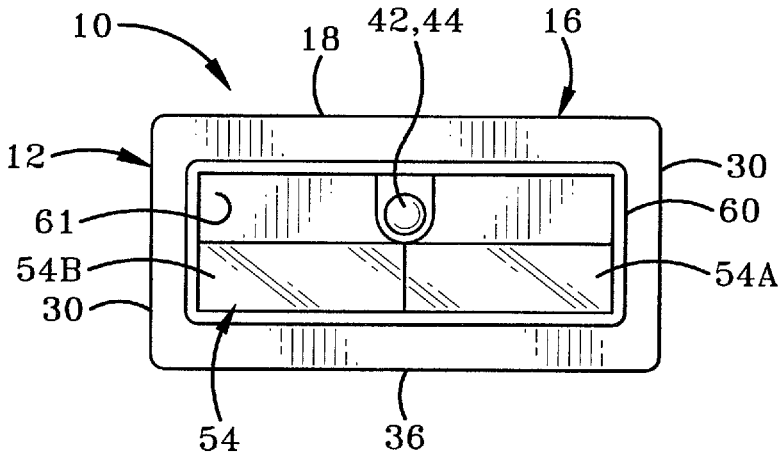
FIG. 9 illustrates a front view of the preferred embodiment of the alarm connector configured as a USB connector.
Figure 10:
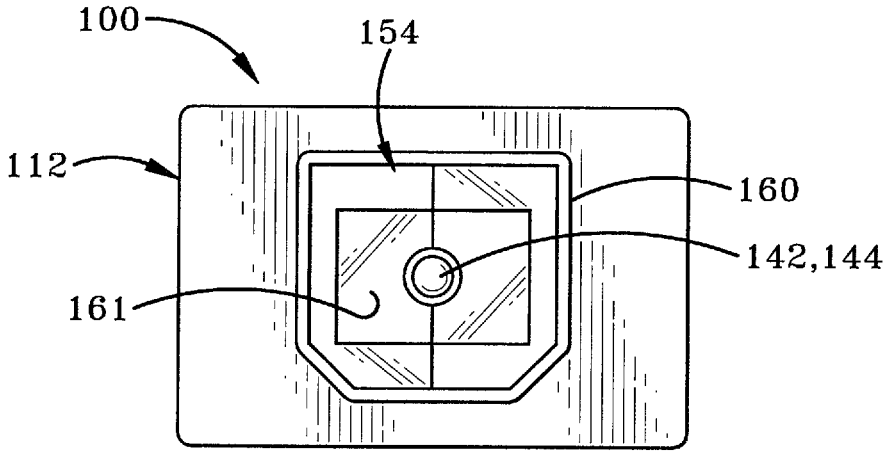
FIG. 10 illustrates a front view of a configuration of the preferred embodiment of the alarm connector configured as a USB-B connector.
Figure 11:
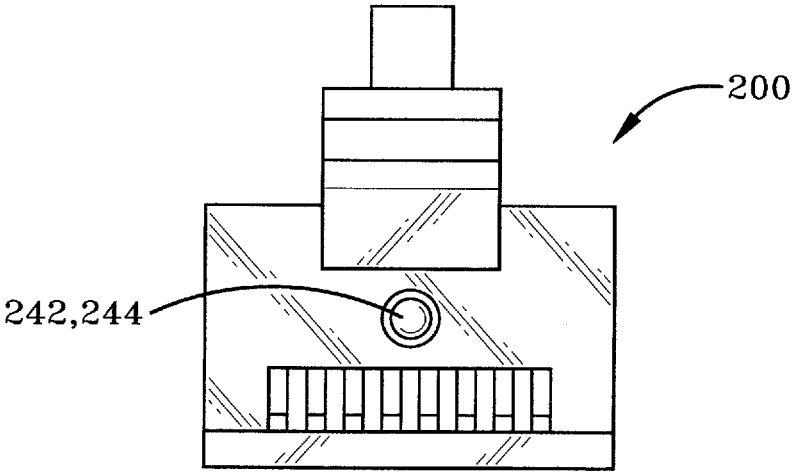
FIG. 11 illustrates a front view of a configuration of the preferred embodiment of the alarm connector configured as an RJ-45 connector.
Figure 12:
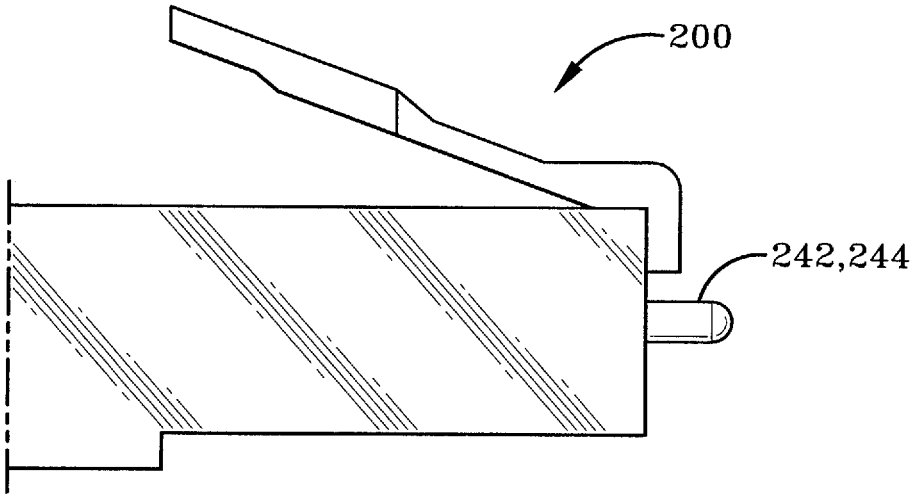
FIG. 12 illustrates a side front view of the configuration of the preferred embodiment of the alarm connector configured as an RJ-45 connector.

FIGS. 9 through 12 show different embodiments of the present invention configured with different standard connectors. FIG. 9 illustrates the preferred embodiment configured as a USB type of standard connector 10 illustrating its front view with its switch 42, plunger 44, main housing 12, circuitry housing 16, bottom wall 36, PCB housing 54, side walls 30, top wall 18, connection shield 60 and opening 61. FIG. 10 illustrates the preferred embodiment configured as a USB-B type of standard connector 100 illustrating its front view with its switch 142, plunger 144, main housing 112, PCB housing 154, connection shield 160 and opening 161. FIGS. 11 and 12 illustrate the preferred embodiment configured as an RJ-45 type of standard connector 200 illustrating its front view with its switch 242 and plunger 244.

We will now discuss the preferred embodiment configured as a method of protecting merchandise items. The example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 13:
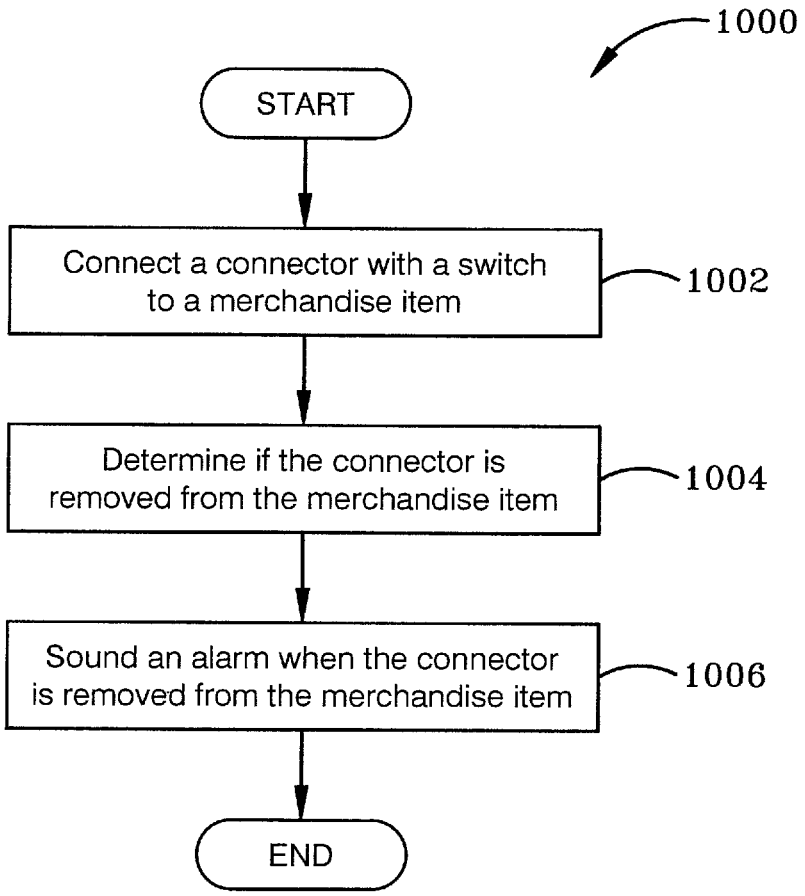
FIG. 13 illustrates an embodiment of a method using the preferred embodiment of the alarm connector for protecting merchandise items.

FIG. 13 illustrates a method 1000 of using an alarm connector 10 to protect a merchandise item 13. Method 1000 begins by attaching a standard connector 10 with a switch 42 included in the standard connector 10 to a merchandise item, at 1002. As discussed above, standard connector 10 is preferably compatible with a USB, RJ-45 or another standard connector socket. Also, switch 42 can be any kind of switch that can detect when standard connector 10 is removed from the merchandise item 13. For example, switch 42 can be a common plunger switch or another type of switch.

A determination is made, at 1004, if connector 10 is removed from the merchandise item 13. For example, if switch 42 was depressed while connector 10 was plugged into the merchandise item 13, but later the alarm logic 4 detects that it is no longer depressed, then the alarm logic 4 can determine that connector 10 has been removed from merchandise item 13. When method 1000 detects that connector 10 is removed from the merchandise item 13, an alarm is generated, at 1006. This alarm can be an audible alarm and/or other types of alarms as understood by those of ordinary skill in the art.

In another configuration of method 1000, method 1000 can include attaching a flexible attachment device 80 to merchandise item 13. Flexible attachment device 80 can be attached to merchandise item 13 by removing a protective layer 96 and sticking it to the merchandise item 13. The other end of the flexible attachment device 80 is held in alarm connector 10 with a locking door 62 that is adapted to release the flexible attachment device 80 when sufficient force is applied to pull it from the door 62. Both ends of a conductive layer 84 within flexible attachment device 80 make contact with a PCB 40 within alarm connector 10 so that when the flexible attachment device 80 is severed or removed from the alarm connector, this configuration of method 1000 will generate an alarm.

Other configurations of method 1000 can include other useful features and actions. For example, method 1000 can illuminate an LED 46 to indicate alarm connector 10 and/or flexible attachment device 80 is attached to the merchandise item 13. An LED 46 or other indicator can indicate that the alarm connector 10 was the connector responsible for generating an alarm after it has been removed from the merchandise item 13.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. An alarm system for protecting a merchandise item comprising:

a connector housing having a portion sized to be received within a connector port on the merchandise item;

a locking door hingedly coupled to the connector housing, wherein the locking door has an open position and a closed position;

an elongated flexible contact connector with a first end attached to the connector housing and a second end adapted to be connected to the merchandise item, the second end having a wider portion than the first end, wherein the elongated flexible contact connector is secured to the connector housing when the locking door is the closed position;

alarm logic configured to generate an alarm when the flexible contact connector is removed from the connector housing or the flexible contact connector is severed; and a plunger switch located at least partially within the connector housing, wherein the plunger switch is positioned to directly contact a surface of the merchandise item located within the connector port in order to switch from an extended position to a depressed position when the portion of the connector housing is received within the connector port.

2. The alarm system of claim 1 wherein the connector housing complies with at least one of the group of: the Universal Serial Bus (USB) standard, the USB type B standard and the Registered Jack-45 (RJ-45) standard.

3. The alarm system of claim 1 further comprising: alarm logic; and a cable connected to and extending outside of the connector housing and adapted to be connected to the alarm logic, wherein the alarm logic is configured to generate an alarm when the plunger switch is moved from the depressed position to the extended position.

4. The alarm system of claim 1 further comprising:

a printed circuit board (PCB) located at least partially in the connector housing with the plunger switch mounted on the PCB.

5. The alarm system of claim 4 wherein the flexible contact connector further comprises:

an electrical conductor forming a loop between two ends of the conductor, wherein the alarm logic is configured to generate an alarm when the loop is severed.

6. The alarm system of claim 4 wherein the two ends of the electrical conductor are in electrical contact with the PCB.

7. The alarm system of claim 4 wherein the elongated flexible contact connector further comprises:

adhesive material adapted for attaching the elongated flexible contact connector to the merchandise item.

8. The alarm system of claim 4 further comprising:

a light emitting diode mounted on the PCB configured to indicate when the connector housing is attached to the merchandise item.

9. The alarm system of claim 4 wherein the housing further comprises: a first portion;

a second portion, wherein the first portion and the second portion wrap round the PCB when the first portion and second portion are connected together.

10. The alarm system of claim 4 further comprising:

a metallic USB cover that is rectangular-shaped and at least partially extends outward from the housing.

11. The alarm system of claim 1 wherein the alarm system is placed in an alarm state when the plunger switch is depressed, and an alarm is generated when the plunger switch is extended after first being placed in the alarm state.

12. The alarm system of claim 1, wherein an electrical conductor is sandwiched between a main layer of the flexible contact connector and a protective layer of the flexible contact connector.

13. The alarm system of claim 1, wherein the locking door is hingedly coupled to a pin mounted in an aperture of the locking door.

14. A method for protecting a merchandise item, comprising:

providing a connector housing having a portion sized to be received within a connector port on the merchandise item;

hingedly coupling a locking door to the connector housing, wherein the locking door has an open position and a closed position;

attaching a first end of an elongated flexible contact connector to the connector housing, wherein the elongated flexible contact connector is secured to the connector housing when the locking door is in the closed position;

attaching a second end of the elongated flexible contact connector to the merchandise item, the second end having a wider portion than the first end;

generating an alarm when the flexible contact connector is removed from the connector housing or the flexible contact connector is severed; and positioning a plunger switch to directly contact a surface of the merchandise item in order to switch from an extended position to a depressed position when the portion of the connector housing is received within the connector port.

15. The method of claim 14, wherein the connector housing complies with at least one of the group of: the Universal Serial Bus (USB) standard, the USB type B standard and the Registered Jack-45 (RJ-45) standard.

16. The method of claim 14, wherein the alarm logic is configured to generate an alarm when the plunger switch is moved from the depressed position to the extended position.

17. The method of claim 14, further comprising forming a loop between two ends of the conductor, wherein the alarm logic is configured to generate an alarm when the loop is severed.

18. The method of claim 14, further comprising indicating, via a light emitting diode, when the connector housing is attached to the merchandise item.

19. The method of claim 14, further comprising placing the alarm system in an alarm state when the plunger switch is depressed, and generating an alarm when the plunger switch is extended after first being placed in the alarm state.

20. The method of claim 14, further comprising sandwiching an electrical conductor between a main layer of the flexible contact connector and a protective layer of the flexible contact connector.

* * * * *